United States Patent [19]

Ford

[11] Patent Number: 4,571,769

[45] Date of Patent: Feb. 25, 1986

[54] COMPACT PERSONAL ROLLER

[76] Inventor: Thomas M. Ford, 7669 Westover Ct., Fair Oaks, Calif. 95628

[21] Appl. No.: 611,712

[22] Filed: May 18, 1984

[51] Int. Cl.[4] ..... B05C 17/02

[52] U.S. Cl. ..... 15/230.11; 15/104.94; 15/244 A; 15/248 A; 29/110.5; 604/310

[58] Field of Search ..... 15/230.11, 244 R, 104.94, 15/244 A, 248 A; 29/110, 110.5, 120; 401/208, 21; 604/1, 289, 310

[56] References Cited

U.S. PATENT DOCUMENTS

| | | | |
|---|---|---|---|
| 4,254,529 | 3/1981 | Cooke | 15/230.11 |
| 4,299,005 | 11/1981 | Brown | 15/244 A |

FOREIGN PATENT DOCUMENTS

| | | | |
|---|---|---|---|
| 37175 | 10/1973 | Canada | 15/248 A |
| WO83/01734 | 5/1983 | PCT Int'l Appl. | 15/104 A |
| 700733 | 12/1953 | United Kingdom | 15/230.11 |
| 1489843 | 10/1977 | United Kingdom | 15/230.11 |

*Primary Examiner*—Edward L. Roberts
*Attorney, Agent, or Firm*—Mark C. Jacobs

[57] ABSTRACT

A compact roller applicator for personal use in the application of sun tan and protective lotions to the body. The small roller, and short handle provides an extension of arms reach, making it possible for oneself to easily and thoroughly apply protective lotions to the area of ones own back. Protective lotion is deposited on the resilient foam roller cover. The protective lotion is then applied to the back, or other areas of the body by light roller movement. The handle and cradle uni-body incorporates a retractable pivotal protective cover for protection of the roller. The retractable pivotal protective cover is held in open or closed position by detent action. The resilient foam covered roller is easily removed for replacement. The compact size, and light weight permits portability.

6 Claims, 9 Drawing Figures

COMPACT PERSONAL ROLLER

SUMMARY

The compact personal roller of the present invention comprises a small, resilient foam covered roller enclosed in the cradle part of the handle-cradle uni-body; a retractable pivotal protective cover that completely encloses the roller, and an axial pin that provides the center of rotation for the retractable cover. The resilient foam is permanently bonded to the outer surface of the plastic cylindrical roller core. The compact personal roller is preferably fabricated of molded plastic materials. The invention provides a simple means for application of sun tan and protective lotions to ones own back, and other areas of the body, to help guard against damage to the skin caused by exposure to the sun. The small size roller is favorably suitable to the contours of the body, thereby providing a means to effectively apply protective lotion. Lotion is deposited directly on the roller, then transferred to the body by gentle roller movement.

DETAILED DESCRIPTION

Figure 1:
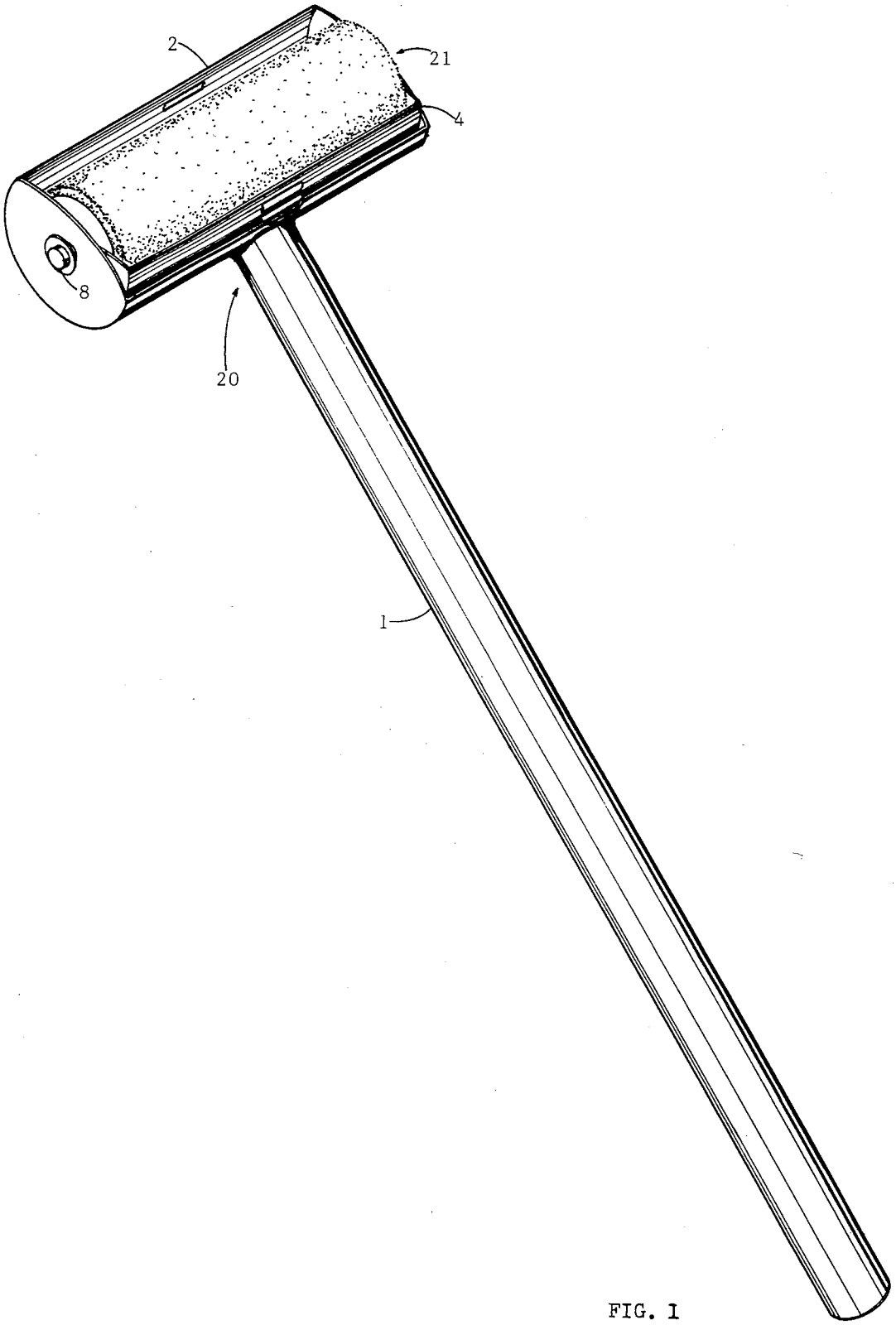
FIG. 1 is a perspective view of the present invention showing the retractable pivotal protective cover in the partially open position, revealing the lotion applying roller.
Figure 6:
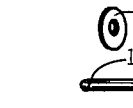
FIG. 6 shows the locking washer.
Figure 5:
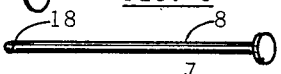
FIG. 5 is a view of the axial pin.
Figure 4:
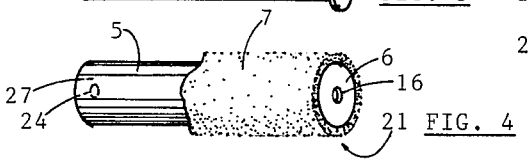
FIG. 4 is a view of the cylindrical, resilient foam covered roller.
Figure 3:
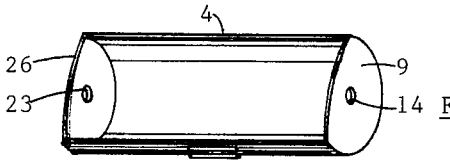
FIG. 3 shows the retractable pivotal protective cover.

Referring to FIG. 1, the compact personal roller 20 is shown. The compact personal roller 20 comprises a molded uni-body consisting of handle 1, approximately 12 inches in length, and roller cradle 2 constituting an overall length of the compact personal roller 20 of approximately 13½ inches. Retractable pivotal protective cover 4 "nests" in roller cradle 2 when in open position. Referring to assembly view of compact personal roller 20 illustrated in FIGS. 2, 2A, FIG. 3, FIG. 4, FIG. 5, and FIG. 6, roller 21 is installed into retractable pivotal protective cover 4 which in turn is installed into roller cradle 2. The assembled parts of compact personal roller 20 are secured by inserting axial pin 8 into axial pin hole 13 of roller cradle 2. Axial pin 8 extends through axial pin hole 14 of retractable pivotal protective cover 4, and through axial pin hole 16 of roller 21. Axial pin 8 is further inserted through the opposite pin hole 24 of roller 21, then through the opposite pin hole 23 of retractable pivotal protective cover 4, and finally through opposite axial pin hole 22 of roller cradle 2. Locking washer 19 is placed over the shaft end of axial pin 8, and forced into position in locking washer groove 18. The position of axial pin 8 provides the rotating axis for the retractable mode of retractable pivotal protective cover 4, and the rotating mode of roller 21. Mounting holes for axial pin 8 are formed during the molding process of the plastic parts. All parts of the compact personal roller 20 are plastic materiel except the resilient foam roller cover 7. Referring to FIG. 4, axial pin hole 16 is formed in cylindrical roller core end plate 6. Opposite axial pin hole 24 is formed in opposite cylindrical roller core end plate 27. Referring to FIG. 3, axial pin hole 14 is formed in retractable pivotal protective cover end plate 9. Opposite axial pin hole 23 is formed in opposite retractable pivotal protective cover end plate 26.

Figure 2A:
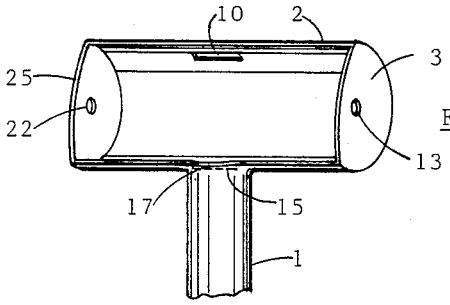
FIG. 2 shows the handle and cradle uni-body, FIG. 2A the cradle.
Figure 7:
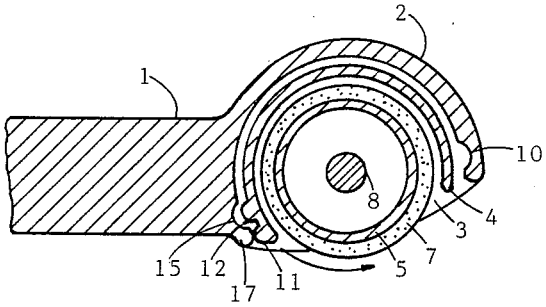
FIG. 7 is a cross section view of the retractable pivotal protective cover in open position.
Figure 8:
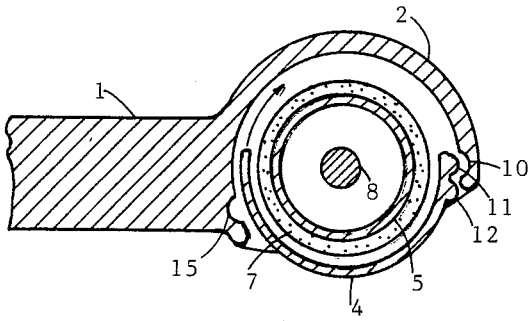
FIG. 8 is a cross section view of the retractable pivotal protective cover in closed position.
Figure 2:
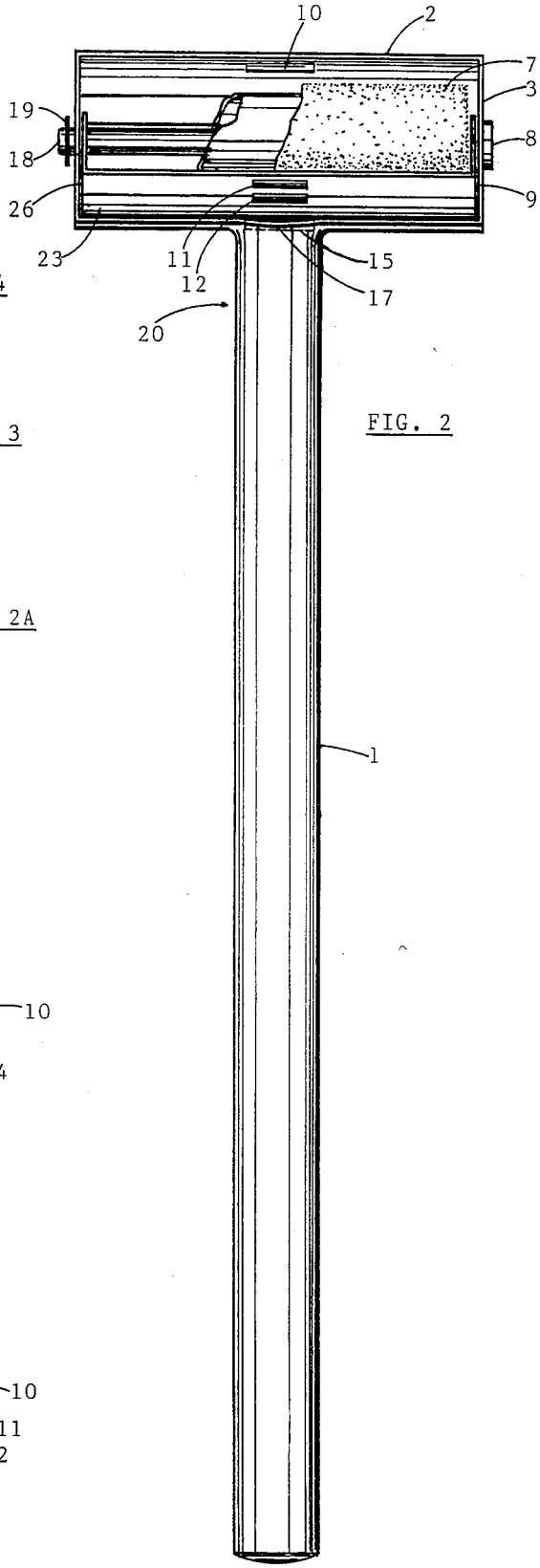

Referring to FIG. 2A axial pin hole 13 is formed in roller cradle end plate 3. Opposite axial pin hole 22 is formed in opposite cradle end plate 25. Referring to FIG. 2A the open, and close position feature of compact personal roller 20 uses raised rib 11 to hold retractable pivotal protective cover 4 in closed position by resting in detent recess 10. Raised rib 12 holds retractable pivotal protective cover 4 in open position by resting in detent recess 15. FIG. 2A shows thumb cut-out 17 on roller cradle 2 which provides space for thumb tip pressure for operation of retractable pivotal protective cover 4. FIG. 7 shows retractable pivotal protective cover 4 held in open position by detent function of raised rib 12 resting in detent recess 15. Raised rib 11 is exposed by thumb cut-out 17 for thumb tip pressure to close retractable pivotal protective cover 4. FIG. 8 shows retractable pivotal protective cover 4 held in closed position by detent function of raised rib 11 resting in detent recess 10. Raised rib 12 is exposed for thumb tip pressure to open retractable pivotal protective cover 4. In conclusion, the present invention provides a simple, easy, and convenient means to apply protective lotion to ones own back, or to other areas of the body that are difficult to reach. The configuration of the human body is such that a person cannot reach the entire area of ones own back. This invention will overcome such physical limitation by providing extension of arm reach, thereby enabling the user to reach the area of the back for the purpose of applying protective lotion. The invention will also aid the aged, and physically handicapped. The small roller is favorable for use in applying protective lotions to the body. The overall length of the compact personal roller provides adequate extension for the roller to reach the area of the back as well as other areas of the body. The retractable pivotal protective cover provides desireable protection for the roller, as well as protection against the possibility of personal articles coming in contact with the roller.

What is claimed is:

1. A roller device for the application of liquids upon the human skin comprising:

a holder for a roller, a cylindrical roller rotatably supported in the holder, and an arcuate cover for the roller, wherein the holder comprises a partially cylindrical member having a distal edge and a proximal, edge defining an open portion along one side thereof, said holder having spaced closed ends, and having a detent recess on each of the proximal and distal edges;

the cylindrical roller's outer surface having a covering of a liquid absorbing material which is capable of releasing a liquid stored therein temporarily, upon the application of pressure upon said covering;

the arcuate cover being a partially cylindrical member, larger than said roller, rotatably mounted about a common rotational coaxial axis with said roller, and being interposed between said holder and said roller;

said cover having a pair of closely spaced first and second bosses adjacent the same edge of the partial cylindrical member, each boss being disposed inwardly from that edge a different distance, and each of which bosses is adapted to engage a different one of the detent recesses of said holder;

said cover being movable from a first position to a second position, the first position being internal between the cover and the roller thereby permitting usage of the roller; the second position being external of the holder and covering the roller thereby denying access to said roller, whereby when said cover is in the first position, one of said bosses engages a detent recess on the proximal edge of said holder, and when said cover is in the second position, the other of said bosses engages a detent recess on the distal edge of said holder.

2. In the device of claim 1 wherein the roller covering is removable and is made of foam rubber.

3. In the device of claim 1, wherein the holder, cover and handle are all made of plastic.

4. In the device of claim 1 wherein the roller is rotatably mounted on a single pin that extends through each end of said holder.

5. The device of claim 1 further including a finger notch on the proximal side of said holder adjacent said detent recess.

6. The roller device of claim 1 further including a handle mounted on said holder normal to the length thereof.

* * * * *